United States Patent [19]

Schneider et al.

[11] 4,272,362

[45] Jun. 9, 1981

[54] PROCESS TO UPGRADE SHALE OIL

[75] Inventors: Abraham Schneider, Overbrook Hills, Pa.; Elmer J. Hollstein, Wilmington, Del.; Edward J. Janoski, Havertown; Edward G. Scheibel, Media, both of Pa.

[73] Assignee: Suntech, Inc., Philadelphia, Pa.

[21] Appl. No.: 117,610

[22] Filed: Feb. 1, 1980

[51] Int. Cl.[3] ..... C10G 45/02; C10G 67/06

[52] U.S. Cl. ..... 208/254 H; 208/87; 208/290; 208/291; 208/311; 208/330; 208/333

[58] Field of Search ..... 208/254 H, 87, 290, 208/291, 311, 330, 333

[56] References Cited

U.S. PATENT DOCUMENTS

| | | | |
|---|---|---|---|
| 1,728,156 | 9/1929 | Wheeler et al. | 208/263 |
| 2,112,313 | 3/1938 | Sowers | 208/263 |
| 2,210,542 | 8/1940 | Burns | 208/263 |
| 2,518,353 | 8/1950 | McKinnis | 208/263 |
| 2,606,143 | 8/1952 | Smith et al. | 208/254 |
| 2,662,843 | 12/1953 | Castner et al. | 208/254 |
| 2,741,578 | 4/1956 | McKinnis | 208/254 |
| 2,754,248 | 7/1956 | Wetzel | 208/254 |
| 2,769,767 | 11/1956 | Fierce et al. | 208/263 |
| 2,925,379 | 2/1960 | Fleck et al. | 208/254 |
| 2,925,380 | 2/1960 | Fleck et al. | 208/254 |
| 2,925,381 | 2/1960 | Fleck et al. | 208/254 |
| 2,943,049 | 6/1960 | Nahin et al. | 208/254 |
| 2,944,014 | 7/1960 | Hoffman | 208/263 |
| 2,956,946 | 10/1960 | King et al. | 208/263 |
| 3,260,666 | 7/1966 | Flinn et al. | 208/254 H |
| 3,717,571 | 2/1973 | Schulman | 208/254 H |
| 4,133,745 | 1/1979 | Wunderlick | 208/254 H |
| 4,159,940 | 7/1979 | Smith | 208/254 H |

*Primary Examiner*—Delbert E. Gantz
*Assistant Examiner*—G. E. Schmitkons
*Attorney, Agent, or Firm*—J. Edward Hess; Donald R. Johnson; Anthony Potts, Jr.

[57] ABSTRACT

Oxygen compounds are removed, e.g., by solvent extraction, from a shale oil prior to its hydrogenation. As a result, the amount of hydrogen consumed during subsequent hydrogenation to achieve a given level of nitrogen for the shale oil is less than that which would occur if the oxygen compounds were not removed from the shale oil. Removal of the nitrogen is necessary to avoid adverse effects on subsequent shale oil processing steps such as catalytic cracking.

6 Claims, No Drawings

PROCESS TO UPGRADE SHALE OIL

BACKGROUND

This invention was made during the course of U.S. Government Contract F33615-78-C2024 with the U.S. Department of Defense.

1. Field of the Invention

This invention relates to an improvement in the hydrogen treating of a shale oil, i.e., an oil derived from shale rock via various conversion processes. Generally, compared to a petroleum crude oil, shale oil contains significantly more nitrogen. More specifically, the invention involves the reduction of oxygen compounds in a shale oil prior to its treatment with hydrogen. Reduction in oxygen compounds results in reducing the amount of hydrogen consumed to achieve a given nitrogen level in a shale oil compared to the amount that would be necessary if the oxygen compounds were not removed.

2. Description of the Prior Art

Removal of nitrogen compounds, using magnesium silicate, from shale oil is disclosed in U.S. Pat. No. 2,606,143. U.S. Pat. No. 2,741,578 discloses using an organic hydroxy compound, e.g., ethylene glycol, to extract nitrogen compounds from a shale oil. Selective extraction of basic materials, including nitrogen compounds, from shale oil via the use of a mixture of sulfur dioxide and water is suggested in U.S. Pat. No. 2,754,248. Another of U.S. Pat. No. 2,662,843 discloses the use of formic acid to remove nitrogen compounds from shale oil; it also discloses that the acid will remove oxygen compounds. The use of synthetic or natural siliceous mineral having base exchange properties converted into the acid or hydrogen ion condition, to denitrogenate a shale oil is disclosed in U.S. Pat. No. 2,943,049. Another U.S. Pat. No. 2,925,381, discloses the use of a solid metallo alumino silicate having substantially uniform pores of at least 7 A. in diameter to remove nitrogen compounds from a shale oil. The same patent also discloses the use of catalytic hydrogenation to lower the amount of nitrogen compounds in hydrocarbons; it also indicates the use of Fuller's earth. U.S. Pat. Nos. 2,925,380 and 2,925,379 disclose processes similar to the last aforementioned patent. U.S. Pat. No. 2,518,353 discloses the use of acid ammonium or amino, or salts of strong non-volatile acids in an aqueous solution as an extraction solvent for removing nitrogen compounds from shale oil. It also mentions the use of diluted strong mineral acids such as sulfuric acid; the use of relatively strong organic acids; the use of extraction solvents including aniline, furfural, isopropyl alcohol and nitrobenzene. U.S. Pat. No. 3,717,571 discloses the use of a two stage hydrogenation reaction system to lower the nitrogen content of a raw shale oil. U.S. Pat. No. 4,133,745 discloses fractionating a raw shale oil into (1) a naphtha cut which is hydrotreated; (2) a gas oil cut which is first treated with caustic to remove arsenic and similar materials and then hydrotreated. The object of the aforementioned processing is to remove both nitrogen compounds and arsenic and similar materials. U.S. Pat. No. 4,159,940 discloses mixing a shale oil with a mineral acid and then after settling, mildly hydrotreating the low nitrogen shale oil phase, whereas the acid shale oil phase is neutralized with a base and the resulting high nitrogen shale oil is subjected to severe hydrotreatment.

Also, petroleum liquids generally are known to contain oxygen compounds, e.g., phenols and naphthenic acid, e.g., see U.S. Pat. No. 1,728,156. Removal of such oxygen compounds by use of basic materials are disclosed in e.g., U.S. Pat. Nos. 2,112,313 and 2,210,542. Extraction of organic acids from petroleum distillates is known, e.g., see U.S. Pat. No. 2,769,767 which discloses treating the distillate with a mixture of an aliphatic organic amine, a low boiling alcohol and water. Other techniques for removing acids from petroleum distillates are disclosed e.g., see U.S. Pat. No. 2,956,946. U.S. Pat. No. 2,944,014 discloses treating an acidic petroleum crude with an alkali in an atmospheric distillation unit; taking the resulting soap-oil mixture and separating out the oil which is then fed to a vacuum distillation unit along with other heavier fractions which have been obtained by vacuum distillation of the fraction, taking one of the streams from the vacuum units and feeding it to a hydrogenation unit. The purpose of the foregoing treatment is to recover naphthenic acids and to obtain high boiling neutral lubricating oil distillates. However none of the foregoing references disclose or suggest removing oxygen compounds from shale oil as a means of improving subsequent hydrodenitrogenation.

Also U.S. Pat. No. 3,260,666 discloses treating a petroleum fraction, e.g., a fluid catalytically cracked furnace oil, with an aqueous potassium hydroxide to remove nitrogen compounds, thereby allowing a subsequent hydrogenation to be more effective. It also suggests that the aqueous potassium hydroxide treatment is applicable to products produced by pyrolysis of carbonaceous materials such as shale oil. However, applicants' treatment of a shale oil with potassium hydroxide failed to improve subsequent hydrotreatment.

SUMMARY OF THE INVENTION

Present invention provides an improvement in the processing of shale oil in that prior to hydrotreating the shale oil some oxygen compounds contained therein are removed. Removal or reduction in oxygen compounds surprisingly facilitates the next processing step; the hydrotreating of the treated shale oil. One of the advantages obtained by the oxygen removal is that less hydrogen is necessary to reduce the level of nitrogen of the shale oil. Another advantage is that the amount of hydrogen required to reduce the nitrogen content of a shale oil to a given level is less than that required for a comparative non-treated shale oil.

The removal or reduction in the amount of the oxygen compounds can be achieved by physical means. For example, the removal or reduction in the amount of oxygen compounds can be accomplished by treatment of a shale oil, including whole crude shale oil, a crude shale oil fraction using extraction means. Included in the latter is solvent extraction using a suitable solvent, for example, aqueous methanol, and dimethylformamide.

DESCRIPTION

This invention is a process improvement in the contacting of a shale oil with hydrogen and a hydrogenation catalyst at suitable hydrogenation conditions. The improvement involves, prior to the contacting, the removal of oxygen compounds contained in the shale oil such that the amount of nitrogen removed per unit of hydrogen consumed during the hydrogenation of the shale oil is less than that which would occur during hydrogenation of the shale oil from which the oxygen compounds were not removed. In one preferred embodiment the amount of oxygen compounds removed is sufficient to substantially decrease the amount of hydrogen consumed compared to the amount consumed in the hydrogenation of a non-treated shale oil. In a more preferred embodiment the hydrogenation process is a denitrogenation one in that a denitrogenation catalyst and suitable denitrogenation operating conditions are employed. In the previous embodiments a still more preferred process employs the removal of oxygen compounds by contacting the shale oil with an extraction solvent, which is highly selective for oxygen compounds in shale oil, at suitable extraction conditions and then separating the solvent-extract and raffinate. Further involved can be the separation of the solvent from the solvent-extract and the subsequent processing of the extract. The raffinate is subsequently treated with hydrogen under suitable conditions and with a suitable catalyst whereby the amount of hydrogen consumed would be less compared to the hydrotreatment of a non-treated shale oil.

"Hydrodenitrogenation" as used herein refers to the use of hydrogen in the removal of the nitrogen compounds contained in a shale oil whereas "hydrogenation" refers to the treatment of a shale oil with hydrogen.

The nitrogen compounds contained in the shale oil generally are converted to hydrocarbons and ammonia by contacting the shale oil with hydrogen in the presence of a suitable catalyst and at suitable operating conditions as to temperature and pressure. Often the foregoing is referred to as the removal of nitrogen compounds. Many different kinds of suitable catalyst are available and often they are referred to as a hydrogenation or a denitrogenation or a hydrodenitrogenation catalyst. Examples of such catalysts are as follows: nickel-molybdenum on alumina, cobalt molybdenum on alumina and nickel-tungsten on alumina. Catalysts which are inexpensive and still effective are preferred and examples of these are nickel-molybdenum and cobalt-molybdenum. The temperature for the hydrogenation treatment can be in the range of between from about 300° C. to about 450° C. with about 350° C. to about 425° C. preferred. The pressure, i.e., the partial pressure of the hydrogen, can be in the range of between from about 200 psig to about 5000 psig with about 1000 psig to about 4000 psig preferred. Generally the nitrogen level ($N_T$) of the resulting product can be at a level which permits the feed to be used without further processing in a hydrocracker or a catalytic cracking unit. Current maximum economical process level of nitrogen is about 0.3 wt.% but more typically processed petroleum liquids contain about 0.1–0.15 wt.%. It should be noted that while hydrodenitrogenation is occurring, other hydrogenation reactions, such as desulfurization, can also be occurring.

"Shale oil" as used herein refers to the organic oil obtained by pyrolyzing oil shale. It also refers to whole crude shale oil or fractions thereof. "Crude" indicates that the oil is from a pyrolyzing process and is without further processing while "whole" indicates no separation into fractions.

In this invention, e.g., a whole crude shale oil can be first treated to remove oxygen compounds or the oil separated into different boiling point fractions and each or certain fractions can be treated so as to remove or reduce the amount of the oxygen compounds in the oil. The distribution of oxygen and nitrogen compounds throughout the whole crude shale is not uniform. Thus, for example, a light naphtha fraction, e.g., one boiling up to about 250°–325° C. probably could be fractionated from the whole crude shale oil since it does not contain adverse amounts of oxygen and/or nitrogen compounds. Consequently, the preferred feed for the present invention is one with a boiling range from between about 250°–325° F. to about 1050° F. with a more preferred boiling range from between about 325° F. to about 850° F.

Thus, in this invention the feed, e.g., can be the whole crude shale oil or a suitable fraction, either of which require further processing to reduce its nitrogen content. The feed is first treated by physical means to remove oxygen compounds contained therein. The amount removed can be as low as e.g., 30–40 wt.%, however, it can be substantially more. The amount and/or kind that should be removed can be determined by an economic balance of the cost of removal versus the value of benefit, particularly to the point where the incremental cost of removal equals the incremental value of benefit. One element of the benefit is the increased effectiveness of the hydrogen used. Thus generally the effect of the oxygen compound removal is that the amount of hydrogen necessary to lower the nitrogen content of a shale oil is less than that which would be required for the hydrotreatment of a non-treated shale oil.

The removal of the undesirable oxygen compounds from a shale oil including whole crude shale oil or its fractions can be accomplished by physical means. For example, the shale oil can be contacted with a suitable extraction means which can be exemplified by liquid extraction using a suitable solvent which is selective for oxygen compounds contained in the shale oil, e.g., aqueous methanol or dimethylformamide.

The removed oxygen compounds, generally oxygenated hydrocarbons, can be separated from the solvent by various means and then used. Included in the latter are hydrotreating the oxygen compounds at conditions optimum for oxygen compounds to produce more hydrocarbons. Also the oxygen compounds could be burned as fuel or reacted to produce hydrogen which then could be used in a hydrodenitrogenation step or other hydrogen consuming processing step. Another alternative is that the oxygen compounds could be used for chemical purposes. Following is an embodiment of applicants' invention along with comparative examples.

EXAMPLES

The first run is a comparative run; the elemental analysis of whole crude Paraho shale oil used as feed is shown in Table I. Column 1 indicates the elemental analysis of the crude oil whereas Column 2 indicates the elemental analysis of the oil after it is contacted with hydrogen and a Ni-Mo catalyst at suitable conditions. The hydrotreating was conducted in a one liter, 316 stainless steel, stirred autoclave equipped with necessary auxilliary devices.

The second run is another comparative example wherein the whole crude Paraho shale oil was first treated with aqueous KOH and the resulting treated oil had the element analysis shown in Column 3. The treated oil was then contacted with hydrogen and a Ni-Mo catalyst at the same conditions for the whole crude Paraho shale oil. The hydrotreated treated oil has the elemental analysis shown in Column 4.

The third run demonstrates applicants' invention. The whole crude Paraho shale oil was first extracted with DMF (dimethylformamide) and the resulting treated oil had the elemental analysis shown in Column 5. The resulting raffinate was then contacted with hydrogen and a Ni-Mo catalyst at the conditions for the previous two runs and the hydrotreated raffinate has the elemental analysis shown in Column 6.

The hydrotreatments of the three feeds were performed in the following manner. The autoclave was charged with the amount of feed shown in Table I along with 200 psig of $H_2S$ and 15 grams of 1/16 inch extrudate catalyst. Sulfiding of the catalyst was carried out by heating the stirred mixture at 200° C. for 2 hours, after which the autoclave was cooled, vented, and purged of the $H_2S$ with hydrogen. Sufficient hydrogen was then added to raise the pressure to 1000 psig after which the autoclave was heated to 375° C. at a rate of about 2° C. per minute. Once the autoclave and its contents reached 375° C., more hydrogen was added to bring the pressure to 2600 psig. The temperature of 375° C. was maintained for 300 minutes, after which both the autoclave and contents were cooled quickly to room temperature with the aid of an external cooling jacket. During the reaction the reaction pressure dropped from 2600 to 2400 psig at which point it was vented to 2300 psig to purge some offgasses, such as methane, and then repressured with hydrogen to 2600 psig. Liquid samples were taken periodically through a dip tube which was fitted with a 2 micron sintered stainless steel filter. The periodical samples were analyzed; however, the results are not shown in Table I, only the results for the final liquid product, obtained by draining the autoclave, and then filtering the liquid, are shown in Table I.

The data shown in Table I, demonstrates the advantages of applicants' method. It required less hydrogen to reduce the nitrogen content of the DMF raffinate than it took to reduce the nitrogen content of the whole crude; 3.23 gm vs. 5.16 gm. Further the level of the remaining nitrogen in the DMF raffinate was much lower than that for the whole crude; 0.581 wt.% vs. 0.853 wt.%.

The data in the Table can be used to calculate more precisely the advantage of applicants' method as to hydrogen usage. For the whole crude the reduction in $N_T$ amounted to 2.95 gm. (285.0 gm×(0.01889–0.00853)=2.95 gm). The amount of hydrogen to remove the 2.95 gm of $N_T$ was 5.16 gm or 0.59 gm of $N_T$/gm of H. A similar value can be calculated for the applicants method, i.e., 0.64 gm of $N_T$/gm of H; for the KOH raffinate the value 0.55 gm of $N_T$/gm of H. The higher the value of $N_T$ per gm of H the more effective is the process. These values indicate that hydrogen effectiveness is better using applicants' method.

The foregoing values can also be used to suggest how effectively applicants' method uses hydrogen. To reduce the $N_T$ level of the hydrotreated whole crude from 0.853 wt.% (Column 2) to 0.581 wt.%, the $N_T$ level of applicants' raffinate, additional hydrogen would be necessary. Assuming the hydrogen consumption would be the same as it previously was, then to reduce the nitrogen level of the whole crude from 0.853 wt.% to the 0.581 wt.% of applicants' raffinate would require an additional 1.32 gm of hydrogen $$\left[\frac{(0.00853 - 0.00581) \times 285 \text{ gm})}{0.59 \text{ gm of } N_T/\text{gm of H}}\right]$$

for a total of 6.48 gm of H. Compared to applicants' consumption of 3.23 gm of H the reduction in hydrogen consumption amounts to about 50%.

Hydrodenitrogenation rate constants were calculated for overall hydrodenitrogenation and hydrodeoxygenation based on the previous runs. These constants are shown in Table II.

TABLE I

Comparison of Hydrotreating of Shale Oil versus Oxygen Reduction plus Hydrotreating

| | Whole Crude | | KOH Raffinate[a] | | DMF Raffinate[b] | |
|---|---|---|---|---|---|---|
| Feed | (1) Before | (2) After | (3) Before | (4) After | (5) Before | (6) After |
| H Treatment | | | | | | |
| Amount of Feed gms. | 285.0 | — | 270.2 | — | 270.0 | — |
| Analysis, wt. % | | | | | | |
| C | 84.26 | 85.68 | 84.95 | 85.63 | 84.98 | 85.99 |
| H | 11.31 | 13.03 | 11.48 | 12.94 | 12.44 | 13.33 |
| O | 1.37 | 0.34 | 1.33 | 0.23 | 0.88 | 0.25 |
| $N_T$ | 1.889 | 0.853 | 1.766 | 0.769 | 1.345 | 0.581 |
| $N_B$ | 1.30 | 0.80 | 1.4 | — | — | 0.6 |
| S | 0.70 | 0.15 | 0.77 | 0.30 | 0.58 | 0.17 |
| H/C | 1.61 | 1.82 | 1.62 | 1.81 | 1.76 | 1.86 |
| H Consumed | | | | | | |
| gms | — | 5.16 | — | 4.92 | — | 3.23 |
| wt. % | — | 1.81 | — | 1.82 | — | 1.20 |

[a]The KOH treatment consisted of using 15% aqueous KOH with an equal amount of whole crude shale oil at room temperature and shaking the mixture for about a half hour. Then the mixture is allowed to settle and the upper layer (the oil) was decanted. The upper layer (87 wt. %) was the KOH raffinate.

[b]The DMF treatment consisted of countercurrently extracting the shale oil with DMF and separating some of the shale oil from the extract for the reflux to the extraction system. The extraction unit consisted of 8 stages; the shale oil was added to the 3rd stage; the DMF was added to the 8th stage. In the first stage a portion of the shale oil was separated from the extract by the addition of about 10 vol. % water and the separated oil was passed countercurrently through the extraction system to the DMF. The temperature (~40° C.) was just high enough to keep the waxy solids in solution in the raffinate. The volume ratio of DMF to shale oil was about 1.5 to 1. The yield of the raffinate was about 85 wt. %.

TABLE II

Hydrodenitrogenation and Hydrodeoxygenation Rate Constants

| | First Order Rate Constants ($k/hr^{-1}$) | | |
|---|---|---|---|
| | Whole Crude Shale Oil | KOH Raffinate | DMF Raffinate |
| $N_T$ Removal | 0.15 | 0.18 | 0.16 |
| O Removal | 0.20 | 0.31 | 0.21 |

There appears to be no significant difference in $N_T$ removal rates between the three methods. The rate constants are based on the formula $C_t = C_o e^{-kt}$ wherein $C_t$=concentration at any given time, $C_o$=initial concentration, e=base of natural logarithm, k=rate constant and t=elapsed time.

These constants indicate the rate at which the particular compounds are removed rather than the amount of hydrogen necessary to the compounds. Thus while there appears to be no difference in $N_T$ removal rates, what is of importance is that the improvement results in less costly hydrogen being used.

We claim:

1. In the process of contacting shale oil with hydrogen and a hydrogenation catalyst at effective hydrogenation conditions, the improvement which comprises, prior to the contacting with hydrogen and catalyst, contacting the shale oil with a selective for oxygen compounds to extract said oxygen compounds from the shale oil and separating the solvent-extract containing the extracted compounds from the raffinate, whereby the amount of nitrogen removed per unit of hydrogen consumed during hydrogenation of said raffinate is greater than that which would occur if the oxygen compounds were not removed from the shale oil.

2. Process according to claim 1 wherein solvent is removed from the solvent-extract.

3. Process according to claim 1 wherein the raffinate yield in said extraction is about 85 wt.%.

4. Improvement according to claim 1 wherein the selective solvent is aqueous methanol.

5. Improvement according to claim 1 wherein the selective solvent is dimethylformamide.

6. Process according to claim 1 wherein the hydrogenation catalyst is selected from the group consisting of nickel-molybdenum on alumina, cobalt-molybdenum on alumina and nickel-tungsten on alumina and the hydrogenation temperature is in the range of between from about 300° C. to about 450° C. and the partial pressure of the hydrogen is in the range of between from about 200 psig to about 5000 psig and the amount of nitrogen removed is sufficient so that resulting product can be used as feed to a hydrocracker or a catalytic cracking unit.

* * * * *

UNITED STATES PATENT OFFICE

CERTIFICATE OF CORRECTION

PATENT NO. : 4,272,362

DATED : June 9, 1981

INVENTOR(S) : Abraham Schneider, Elmer J. Hollstein, Edward J. Janoski, Edward G. Scheibel It is certified that error appears in the above-identified patent and that said Letters Patent are hereby corrected as shown below:

Column 7, line 3, after "selective" insert -- solvent --.

Signed and Sealed this

*Twenty-fifth* Day of *January 1983*

[SEAL]

*Attest:*

GERALD J. MOSSINGHOFF

*Attesting Officer*

*Commissioner of Patents and Trademarks*